US005266738A

United States Patent [19]

MacVoy

[11] Patent Number: 5,266,738

[45] Date of Patent: Nov. 30, 1993

[54] UNIVERSAL FIXTURE MOUNT AND METHOD OF ASSEMBLY

[75] Inventor: Douglas W. MacVoy, Bloomfield Hills, Mich.

[73] Assignee: United Lighting Standards, Inc., Warren, Mich.

[21] Appl. No.: 782,519

[22] Filed: Oct. 25, 1991

[51] Int. Cl.[5] ..... E04H 12/08; E04H 12/22

[52] U.S. Cl. ..... 174/45 R; 362/431; 248/159; 52/127.12; D26/68; D26/71

[58] Field of Search ..... 174/45 R, 40 R, 43, 174/149 R, 149 B; 52/40, 697, 127.12, 726.4; 248/906, 159; 361/369; 362/431; D26/67, 68, 69, 70, 71

[56] References Cited

U.S. PATENT DOCUMENTS

| | | | |
|---|---|---|---|
| D. 205,720 | 9/1966 | Villa | D26/71 X |
| D. 219,546 | 12/1970 | Kaiser | D26/68 |
| D. 295,328 | 4/1988 | Ewing et al. | D26/71 |
| 689,387 | 12/1901 | Crossland | 174/45 R X |
| 1,189,459 | 7/1916 | Lundin | 174/45 R |
| 3,343,322 | 9/1967 | Lurkis et al. | 362/431 X |
| 3,369,331 | 2/1968 | Deskey et al. | 52/38 |
| 3,410,995 | 11/1968 | Gray | 52/28 |
| 3,508,731 | 4/1970 | Jablonski | 52/40 X |
| 4,577,449 | 3/1986 | Celli | 52/721 |
| 4,894,759 | 1/1990 | Siems | 174/45 R X |
| 4,914,258 | 4/1990 | Jackson | 174/45 R |

*Primary Examiner*—Leo P. Picard
*Assistant Examiner*—Hyung S. Sough
*Attorney, Agent, or Firm*—Brooks & Kushman

[57] ABSTRACT

A utility light pole having a main pole section and a pole end section adapted for supporting a selected one of a plurality of light fixtures above a base such that once constructed, the pole main section and the pole end section form a uniform exterior appearance. A utility light pole is formed from an elongated tubular pole main section adapted for availability in different lengths and a tubular pole end section provided which is relatively shorter than any available length of the pole main section for attachment to the pole main section. A variety of pole end sections having various mounting hole patterns to accommodate different light fixtures are provided. A first and second adapter plates means provided for securely removably fastening the pole end section to the pole main section so that they may combine to provide a uniform exterior appearance. A utility light pole of uniform exterior appearance is fabricated by fastening a pole main section of the desired length to a pole end section adapted for the light fixture to be attached thereto.

9 Claims, 1 Drawing Sheet

UNIVERSAL FIXTURE MOUNT AND METHOD OF ASSEMBLY

TECHNICAL FIELD

This invention relates to utility light poles and in particular to apparatus and methods for constructing utility light poles from an inventory of components.

BACKGROUND ART

Traditional utility lighting poles have not been standardized and require individualized construction, thereby increasing delivery time and associated costs. Conventional construction of lighting fixtures result in a variety of different attachment devices which requires individually constructed utility lighting poles. Accordingly, when a new utility light pole is requested, it is necessary to construct the utility light pole to correspond to the specific lighting fixture which is to be utilized.

U.S. Pat. No. 3,369,331 to Deskey et al. discloses an attempt at standardizing of the base, shaft, and arm. In this configuration, only the one standardized arm of the light fixture was capable of being received by the shaft.

U.S. Pat. No. 3,410,995 to Gray discloses a lamp post constructed of sectional components which are stored in telescope relation. In this configuration, the standard was not adapted for receiving a plurality of light fixtures.

U.S. Pat. No. 3,508,731 to Jablonski discloses a pole top luminaire mounting device utilizing a collet-type clamping device which slips over the top of a pole. In this configuration, the device is intended for use with a particular light fixture.

U.S. Pat. No. 4,577,449 to Celli discloses a prefabricated structural connector for steel-frame buildings which relates particularly to a prefabricated structure for interconnecting vertical frame columns and horizontal frame beams. The device disclosed does not specifically relate to utility light poles or the connection of light fixtures to utility poles.

U.S. Pat. No. 4,914,258 to Jackson discloses a utility pole having an access opening cover over a raised perimeter access opening. The device disclosed is intended for use with cylindrical, hollow poles which are tapered at the top and provided with a flange at the base.

The present invention incorporates all of the above-known benefits of utility poles while improving the structure thereof.

DISCLOSURE OF INVENTION

The present invention, in an attempt to reduce the delivery time and costs associated with utility light poles, has pole portions of predetermined lengths fabricated and stored in inventory. Universal fixture mounts which correspond to each of the known variety of lighting fixtures are constructed and maintained in inventory. When an order is placed for a utility light pole, the prefabricated portions are shipped to the requesting party for easy on-site assembly. Known art does not teach of such prefabrication and universal mounting ability.

An object of the present invention is to provide a relatively inexpensive prefabricated utility light pole and method for constructing the same from inventory.

Accordingly, an object of the present invention is to provide a universal fixture capable of being adapted to accommodate a plurality of light fixtures.

Another object of the present invention is to provide a standardized pole and universal light fixture capable of being manufactured and stored in inventory of varying dimensions, such that construction of a utility light pole from inventory is easily and inexpensively accomplished.

A specific object of the present invention is to provide a utility pole of uniform exterior appearance adapted for supporting a selected one of a plurality of light fixtures above a base. The light pole comprises an elongated tubular pole main section adapted for availability in different lengths and having a lower end for attachment to a base, an upper end spaced therefrom, and a first exterior appearance surface between said ends. A tubular pole end section is provided which is relatively shorter than any available length of said pole main section for attachment to the pole main section upper end. The pole end section has a second exterior appearance surface. The pole end section includes mounting means adapted for attaching a light fixture thereto. Fastening means is provided for securely removably fastening the pole end section to the pole main section so that the first and second appearance surfaces can combine to provide a uniform exterior appearance to both pole sections. A utility light pole of uniform exterior surface is fabricated by fastening a pole main section of the desired length to a pole end section before a light fixture is attached thereto.

Another object of the present invention is to provide a method of quickly assembling a utility light pole for use with a selected one of a plurality of light fixtures. The steps include providing an inventory of elongated tubular pole main sections of different lengths and common exterior surfaces, each of the pole main sections having a lower end for mounting a pole main section to a base in a generally upright orientation and an upper end spaced thereabove. Providing an inventory of tubular pole end sections relatively shorter than any of the different lengths of the pole main sections and adapted for attachment to the pole main section upper end. Each of the plurality of pole end sections includes an exterior surface common to the exterior surfaces of the main pole sections and mounting means for attaching a light fixture thereto. Selecting from inventory a pole main section having the desired length. Selecting from inventory a pole end section having the desired mounting means for the selected light fixture. Fastening the pole end section to the upper end of the pole main section in a manner to combine the exterior surfaces thereof into a complete utility light pole of the desired length and of common exterior surface suitable for mounting the selected light fixture thereto.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
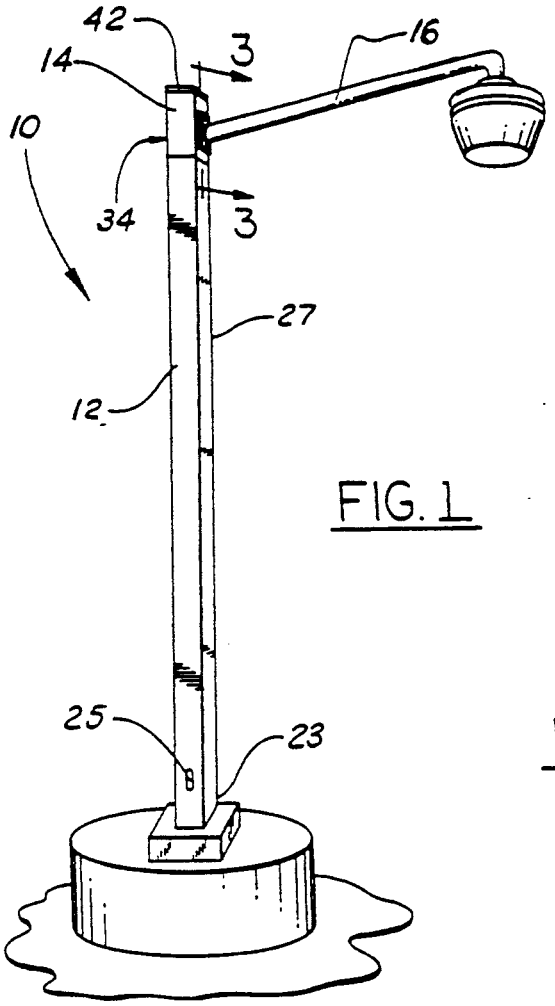
FIG. 1 is a perspective view of the device in accordance with the present invention.
Figure 2:
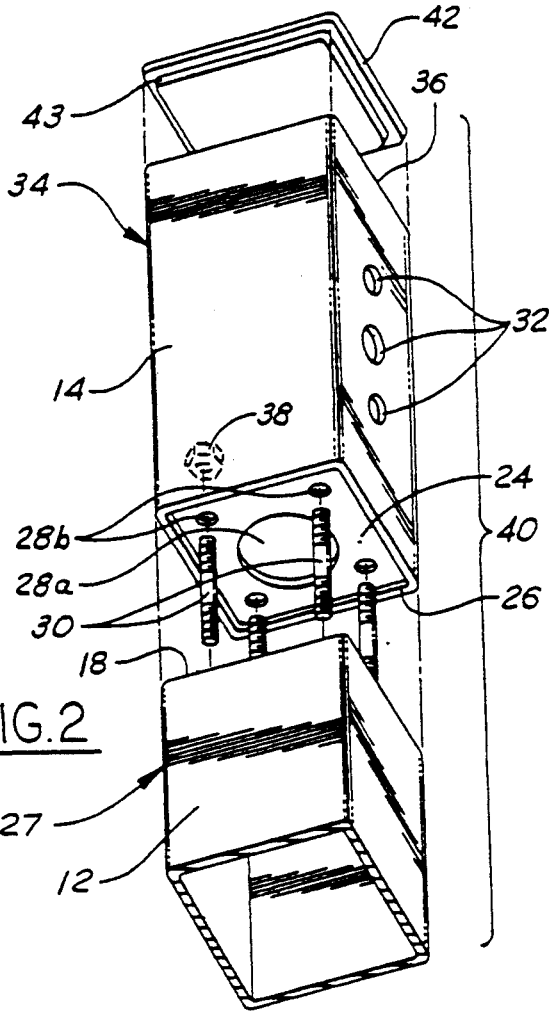
FIG. 2 is a fragmentary exploded view showing all of the elements of the present invention.
Figure 3:
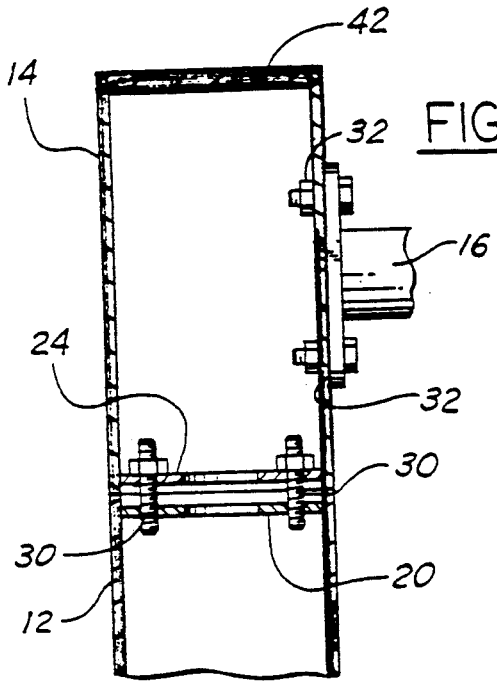
FIG. 3 is a fragmentary cross-sectional view partly in elevation illustrating the pole end section mounted on the pole main section in accordance with the present invention.

The embodiment illustrated in FIGS. 1 through 4 shows a utility pole, generally indicated at 10, including a pole main section 12 and a pole end section 14 for supporting one or more light fixtures 16.

The pole main section 12 is an elongated tubular configuration having a hollow rectangular shape so as to act as a conduit for electrical components (not shown). The pole main section 12 is constructed of steel. The pole main section 12 has a substantially uniform peripheral or circumferential dimension throughout its length. Affixed within an upper end 18 by means of welding or the like, is a first adapter plate 20. The first adapter plate 20 defines a plurality of apertures 22*a* and 22*b* respectively. The aperture 22*a* is centrally located within the first adapter plate 20 to enable the electrical components to fit through the upper end 18. Located near a lower end 23 of the pole main section 12 is an access port 25 allowing access to the electrical components (not shown). Between the upper end 18 and the lower end 23 is a first exterior appearance 27.

The pole end section 14 is also a hollow tubular rectangle constructed of steel. The pole end section 14 has a second adapter plate 24 located at an inner end 26. The second adapter plate 24 has a plurality of apertures 28*a* and 28*b* respectively. Apertures 28*a* and 28*b* correspond with apertures 22*a* and 22*b* enabling cooperation therebetween. Interposed between the first adapter plate 20 and the second adapter plate 24 is a plurality of fastening means such as threaded studs 30 or bolts.

The pole end section 14 has a plurality of sockets 32 located within a second exterior appearance 34 and a free end 36. These sockets 32 mate with a selected one of the plurality of the light fixtures 16.

To assemble the utility pole 10, the desired pole main section 12, pole end section 14, and one or more of the corresponding light fixtures 16 is removed from inventory. The studs 30 are screwed or mounted into the cooperating apertures 22*b* of the first adaptor plate 20. The pole end section 14 is positioned on the pole main section 12 by sliding the second adapter plate 24 over the studs 30, such that the sockets 32 of the pole end section 14 are properly positioned for the light fixture 16 so as to orient the light fixture in the desired direction. Hex nuts 38 or the like are tightened onto the studs 30 within the pole end section 14 so as to secure the pole end section 14 to the pole main section 12 in the desired alignment, thereby combining the first and second exterior appearances 27 and 34, respectively, into a uniform exterior appearance 40. A cap 42 which has a mounting lip 43, is then mounted to cover the free end 36 of the pole end section 14 to complete the assembly of the utility pole 10. The cap 42 creates a substantially watertight seal when it covers the open free end of the pole end section 14. A completed utility pole of desired lengths is now ready for use by the customer. Preferably, the pole main section and the end section will be assembled by the customer who will be installing the light fixtures. The light fixture 16 may then be attached by the customer to the pole end section 14 at the sockets 32 by conventional fastening means. The cap 42 may be removed by the customer to facilitate the attachment.

Figure 4:
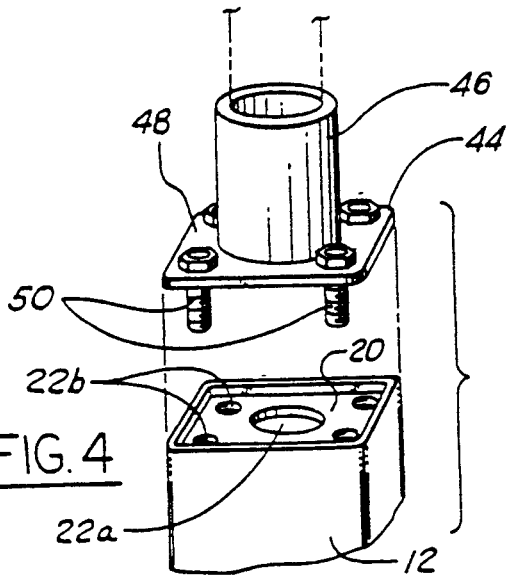
FIG. 4 is a fragmentary exploded perspective view illustrating an alternative embodiment for top mounting of a light fixture.

An alternative embodiment as shown in FIG. 4 utilizes a tenon plate 44 rather than the pole end section 14. The tenon plate 44 has a cylindrical portion 46 adapted to receive a top-mount light fixture (not shown). A flange 48 located at the inner end 26 contains a plurality of apertures 28*b* which cooperate with a plurality of standard bolts 50 which obviates the need for hex nuts 38 to secure the tenon plate 44 to the pole end section 14.

While the best mode for carrying out the invention has been described in detail, those familiar with the art to which this invention relates will recognize various alternative designs and embodiments for practicing the invention as defined by the following claims.

What is claimed is:

1. A utility pole having a longitudinal axis extending along its length, being of uniform exterior appearance and being adapted for supporting above a base a selected one of a plurality of different light fixtures having different predetermined attachment means, the utility pole comprising:

an elongated tubular pole main section adapted for availability in different lengths and having a lower end for attachment to the base, an upper end spaced therefrom, and a first exterior appearance surface;

a tubular pole end section relatively shorter than any available length of said pole main section and having an upper end, a lower end and a second exterior appearance surface, said pole main section and said pole end section each defining an enclosed passage extending completely therethrough along the longitudinal axis to facilitate the installation of and provide protection for electrical components, said pole end section defining a plurality of sockets extending therethrough at substantially right angles to the longitudinal axis, the sockets being disposed in a mounting pattern accommodating the predetermined attachment means of the selected one of the plurality of different light fixtures, at least one of the plurality of sockets being disposed to accommodate the routing of electrical components from the selected one of the plurality of different light fixtures to the passage defined within said pole end section;

a first adapter plate affixed at right angles to the longitudinal axis of, within the passage defined by and proximate the upper end of said pole main section;

a second adapter plate affixed at right angles to the longitudinal axis of, within the passage defined by and proximate the lower end of said pole end section, said first and second adapter plates each defining at least one channel aperture extending therethrough to accommodate the routing of electrical components from the passage defined within said pole end section to the passage defined within said pole main section, said first adapter plate defining a plurality of attachment apertures extending therethrough, said second adapter plate also defining a plurality of attachment apertures extending therethrough; and a plurality of bolts each of which cooperates with a different one of the plurality of attachment apertures in said first adapter plate and an associated one of the plurality of attachment apertures in said second adapter plate for connecting said first adapter plate to said second adapter plate.

2. The utility pole of claim 1, wherein each of the plurality of attachment apertures of said first adapter plate is disposed to align with an associated attachment aperture in said second adapter plate so that the plurality of bolts both align and connect said pole main section and said pole end section so that the respective first and second exterior appearance surfaces combine to form a utility pole having a uniform exterior appearance.

3. The utility pole of claim 1, further including a cap for covering the upper end of said pole end section to create a substantially weather-tight seal.

4. The utility pole of claim 1, wherein the pole main section and the pole end section have a uniform cross section at a point where they are fastened together.

5. The utility pole of claim 1, wherein the utility pole has a uniform cross section throughout its length.

6. The utility pole of claim 1, wherein the utility pole has a square cross section.

7. The utility pole of claim 1, wherein the pole main section and the pole end section are constructed of steel.

8. A method of quickly assembling, from an inventory of elongated tubular pole main sections of different lengths, from an inventory of relatively shorter, elongated tubular pole end sections and from a plurality of bolts, a utility light pole having a longitudinal axis extending along its length and being adapted for supporting above a base a selected one of a plurality of different light fixtures having different predetermined attachment means, each of the pole main sections and the pole end sections having an upper end and a lower end, defining an enclosed passage extending completely therethrough along the longitudinal axis and having an exterior appearance surface of common appearance, each of the pole end sections defining a plurality of sockets extending therethrough at substantially right angles to the longitudinal axis, the sockets being disposed in a mounting pattern accommodating the predetermined attachment means of at least one of the plurality of different light fixtures for attaching at least one of the plurality of different light fixtures to each of the pole end sections, each of the pole main sections having a first adapter plate affixed at right angles to the longitudinal axis within the passage defined therein and proximate the upper end thereof, each of the pole end sections having a second adapter plate affixed at right angles to the longitudinal axis within the passage defined therein and proximate the lower end thereof, each of the first and second adapter plates defining at least one channel aperture extending therethrough and a plurality of attachment apertures extending therethrough, each of the plurality of attachment apertures of the first adapter plate being disposed to align with an associated attachment aperture in the second adapter plate, the method comprising the steps of:

selecting from inventory a pole main section having a desired length;

selecting from inventory a pole end section having sockets disposed in a mounting pattern accommodating the predetermined attachment means of a selected one of the plurality of different light fixtures; and fastening the first adapter plate to the second adapter plate with the plurality of bolts so that the lower end of said pole end section aligns with and abuts the upper end of said pole main section in a manner that forms a complete utility light pole of desired length and of common exterior surface suitable for mounting the selected light fixture thereto.

9. The method of claim 8, wherein the step of fastening said pole end section to the upper end of said pole main section conceals the upper end of said pole main section.

* * * * *